US005427569A

United States Patent [19]

Plymoth

[11] Patent Number: 5,427,569

[45] Date of Patent: Jun. 27, 1995

[54] ADJUSTABLE LOCAL EXTRACTION DEVICE

[75] Inventor: Jan Plymoth, Höllviken, Sweden

[73] Assignee: Plymex Fabriksforsaljning AB, Malmo, Sweden

[21] Appl. No.: 52,108

[22] Filed: Apr. 23, 1993

[30] Foreign Application Priority Data

Apr. 23, 1992 [SE] Sweden ..... 9201286

[51] Int. Cl.[6] ..... B08B 15/04

[52] U.S. Cl. ..... 454/65; 454/63

[58] Field of Search ..... 454/49, 63, 65, 67

[56] References Cited

U.S. PATENT DOCUMENTS

| | | | |
|---|---|---|---|
| 1,898,410 | 2/1933 | Wales . | |
| 2,889,007 | 6/1959 | Lunde | 454/67 X |
| 3,204,392 | 9/1965 | Schwab | 55/381 |
| 3,287,886 | 11/1966 | Tiberi | 55/378 |
| 3,676,986 | 7/1992 | Reiling | 55/472 |
| 3,826,066 | 7/1974 | Higgins | 55/379 |
| 4,038,913 | 8/1977 | Earley | 454/67 X |
| 4,512,245 | 4/1985 | Goldman | 55/419 X |
| 4,756,728 | 7/1988 | Conrad | 55/385 A |
| 4,860,644 | 8/1989 | Kohl et al. | 454/65 |

FOREIGN PATENT DOCUMENTS

| | | | |
|---|---|---|---|
| 0204662 | 12/1986 | European Pat. Off. . | |
| 2229212 | 11/1974 | France . | |
| 2525930 | 11/1983 | France | 454/65 |
| 146941 | 11/1981 | Japan | 454/63 |
| 371111 | 11/1974 | Sweden . | |
| 485663 | 11/1936 | United Kingdom . | |
| 1329844 | 4/1971 | United Kingdom . | |
| 2046858 | 11/1979 | United Kingdom | 454/65 |
| 2238111 | 5/1991 | United Kingdom . | |
| 386211 | 6/1973 | U.S.S.R. | 454/65 |
| 994870 | 2/1983 | U.S.S.R. | 454/65 |

*Primary Examiner*—Harold Joyce

*Attorney, Agent, or Firm*—Merchant & Gould Smith, Edell, Welter & Schmidt

[57] ABSTRACT

Adjustable local extraction device comprising a suction tunnel, an exhaustion device connected to one end of the suction tunnel, and a nozzle connected to a second end of the suction tunnel. A filter is provided within the suction tunnel.

16 Claims, 4 Drawing Sheets

ADJUSTABLE LOCAL EXTRACTION DEVICE

BACKGROUND OF THE INVENTION

To extract smoke, dust and particles from welding places such places normally are provided with some kind of local extraction device. Said local extraction devices normally are provided with a plurality of movable, rods and/or rigid tube sections that are mutually pivoted, and provided with intermediate hose sections.

Preferably said device is attached to a wall or the ceiling where probably also a connection is made to a main line for the extraction of air. In embodiments utilizing a main line there is normally provided a central exhausting device. In some cases there is also provided at each extraction device a separate exhausting device.

The air extracted from the extracting spot is contaminated with smoke, dust and particles. To prevent such contamination from the environment the extracted air has to be cleaned somehow, before it is returned to the ambient air. To accomplish the cleaning of air extracted from the extraction spot it is previously known from the first case described above to complete said central exhausting device with a central filter apparatus. One embodiment of a filter is known from for instance GB 1329844. The device according to said patent comprises a separation chamber and a filter provided in said chamber. Similar embodiments are known also for systems using a central exhausting device.

Previously known types of filter devices to be used within the present technical field are comparatively complicated and normally expensive. When a filter is changed in a central filter device it is necessary to turn off completely the central exhausting device, and thereby all working sites connecting thereto will lack the evacuation of air during the time of exchange. The filter must also be dimensioned according to the type of contamination that requires the highest level of filter capacity. This may effect the actual costs for the filter apparatus in a most adverse way if only one or a few working sites will produce this type of contaminations.

SUMMARY OF THE INVENTION

An object of the present invention is to overcome the problems mentioned above and to provide a local extraction device having a simple, low cost and readily exchangeable filter element. Said filter element is provided locally at each working site, and thereby it is possible to dimension said element according to the actual filtering requirements. Further objects and aspects of the device according to the invention will be more fully understood when the following portions of the specification and dependant claims are read.

The invention will now be described in more detail by means of embodiments in conjunction with the accompanying drawings.

DESCRIPTION OF THE INVENTION

Figure 1:
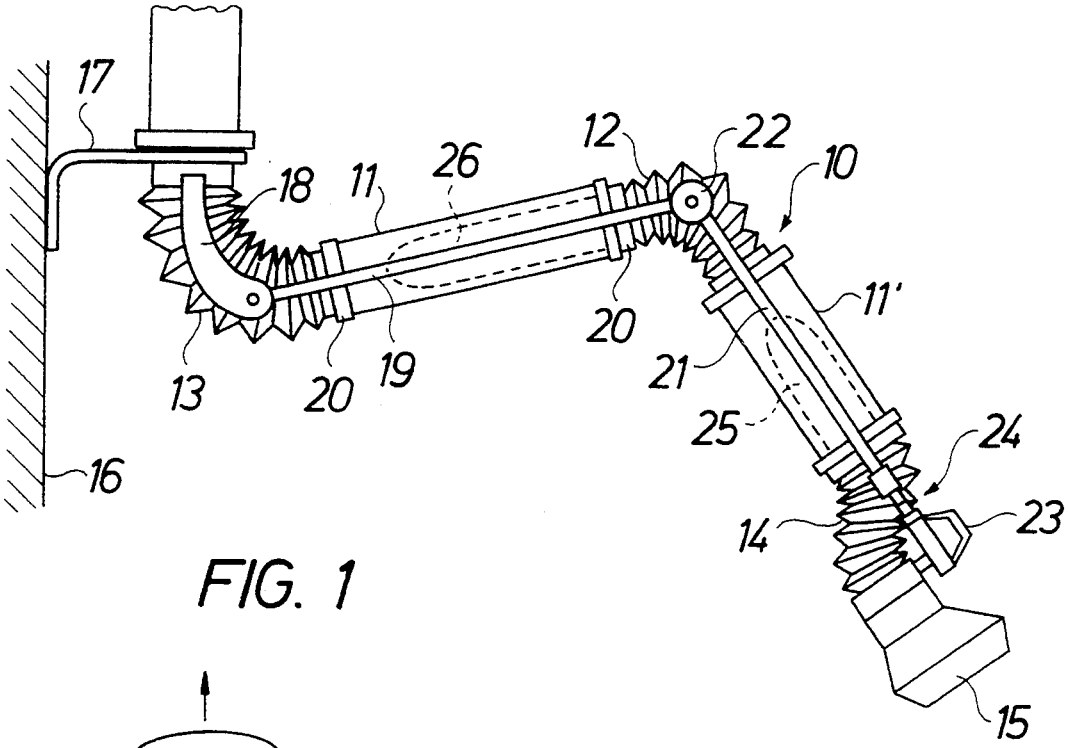
FIG. 1 is a schematic view of a local extraction device according to the invention.

FIG. 1 shows a basic embodiment of a local extraction device according to the invention. The device according to the invention comprises a suction tunnel 10, which in the embodiment shown in FIG. 1 comprises two rigid tube portions 11 and 11' and a hose section 12 arranged intermediate of said tube portions. A first tube portion 11 is connected through a hose portion 13 to a not shown exhaustion device formed as a fan or similar device. A second tube portion 11' is connected through a further hose portion 14 to a suction nozzle or funnel 15. The extraction device is attached to a wall 16 through a wall bracket 17. A curved arm 18 extends from said wall bracket 17, said arm 18 being pivotably connected to an elongated upper arm 19 which supports through a fitting 20 said first rigid tube section 11. A corresponding lower arm 21 supports said second rigid tube section 11'. Intermediate of said upper arm 19 and said lower arm 21 there is provided a link 22 which will allow a relative movement between said arms 19 and 21 at least in one plane. A handle 23 is attached to said funnel 15 for directing said extracting device towards a source of contamination, for instance a welding device. Said handle 23 is connected to a further link 24 to the free end of said lower arm 21. In said second rigid tube portion 11' there is provided a filter 25 formed as a filter bag. Said filter 25 is attached to said tube portion 11' such that any air evacuated through said suction tunnel 16 will pass through said filter. Said filter 25 is readily exchangeable because said tube portion 11' can be opened. Preferably said tube portion 11' can be opened in an axially extending connection.

In an alternative embodiment also said first rigid tube portion 11 is provided with an internal filter 26. In such an embodiment said first filter 25 is provided with a higher permeability than second filter 26. Thereby it is possible to use said first filter 25 to capture coarse particles whereas said second filter 26 merely is used to capture finer particles. Particles normally occuring in the relevant technical field are of a size within the area of 0,2—2 micrometer. The degree of density of said filter 25 is chosen preferably such that 60% by weight of said particles are separated and captured in said filter. A filter having this degree of density ensures that a limit value of 2–5 mg/1000 $m^3$ presently existing will not be exceeded.

Figure 2:
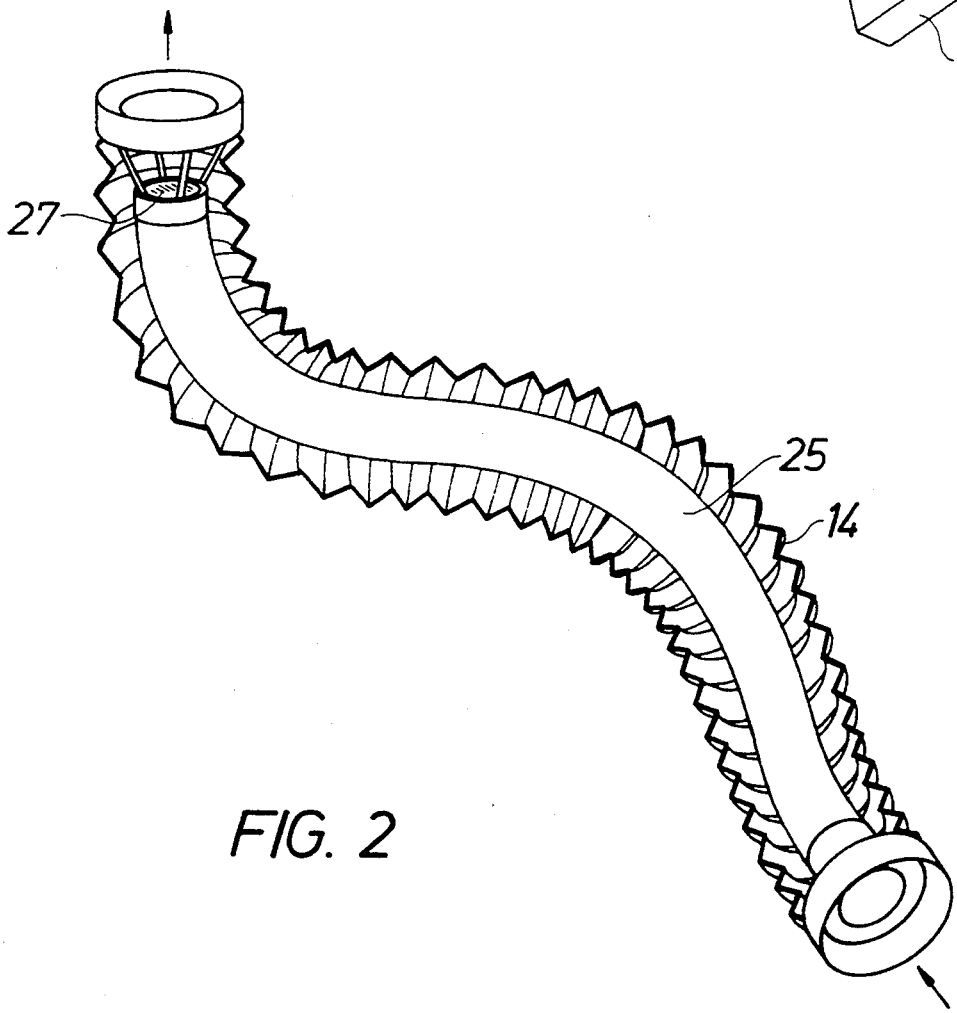
FIG. 2 is a schematic view of an alternative embodiment of a suction hose included in said local extraction device.

An alternative embodiment of the filter means per se is shown in FIG. 2. In this embodiment said filter is made from an elongated hose 25, which is open in one end as an inlet of air from said funnel 15, and which in a second end is closed with a plate 27 or a similar device. In this embodiment air is sucked in through one end of said filter 25. Said air is then exhausted through the cylindrical envelope surface of said filter 25 and is delivered from said filter means through a channel having an annular cross section.

Figure 3:
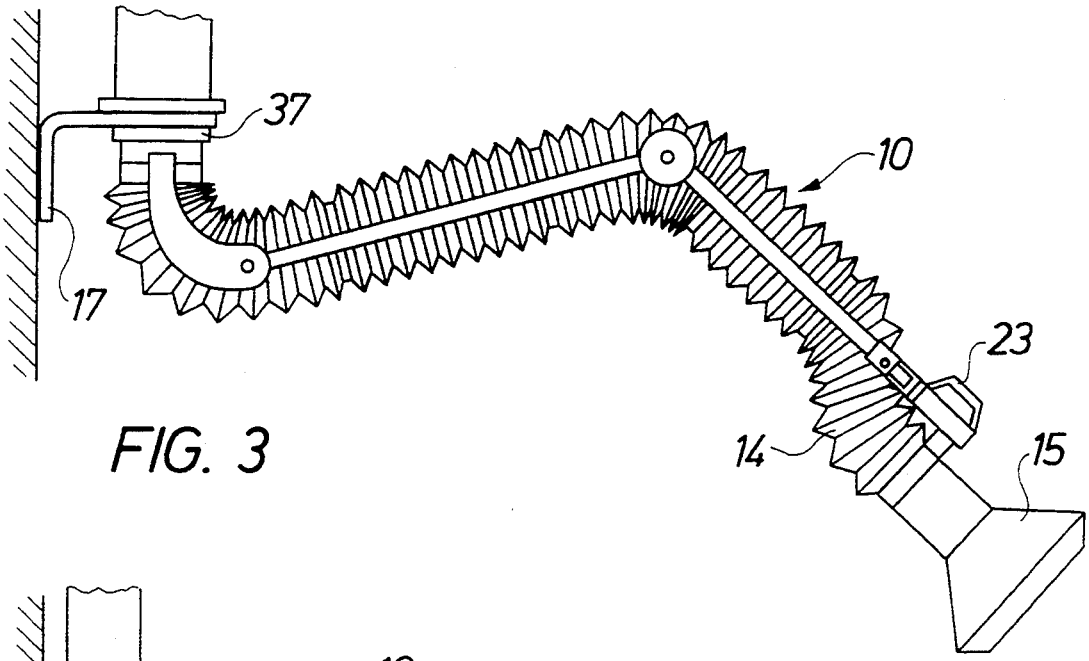
FIG. 3 is a schematic view of an alternative embodiment of the local extraction device according to the invention.
Figure 4:
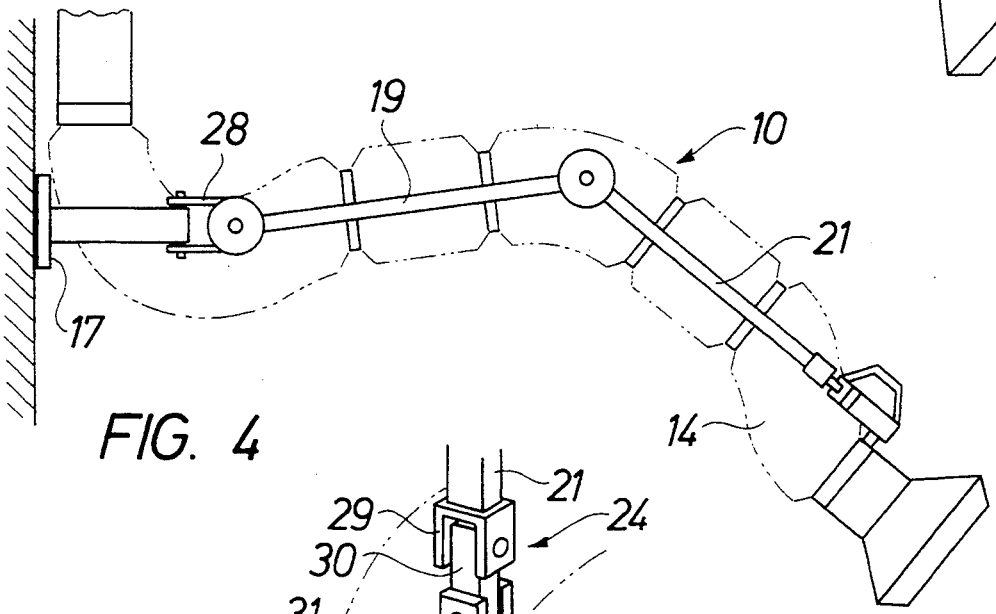
FIG. 4 is a schematic view of a further embodiment of a local extraction device according to the invention.

A filter means according to the embodiment shown in FIG. 2 is most conveniently used in a local extraction device according to FIG. 3 and FIG. 4. In these embodiments rigid tube sections are not used and a suction tunnel 10 is constituted by a flexible hose portion including an internal filter hose according to FIG. 2. The embodiments of FIG. 3 and FIG. 4 differs essentially in the way they are attached to a wall. In the embodiment according to FIG. 3 a swivel 37 is connected to said wall bracket 17 so as to allow a pivoting movement in a horisontal plane to said extraction device. In the embodiment according to FIG. 4 said upper arm 19 is connected to said wall bracket 17 through a link 28 which can be pivoted in two planes at right angles. When the filter means shown in FIG. 2 is used in the embodiment described above with reference to FIG. 1 either one of said tube sections 11,11' or both tube sections 11,11' are constituted by a filter means according to FIG. 2.

Within the scope of present invention it is possible to combine different types of tube and hose elements in considerably more ways than those described directly above. Internal och external support arms can be combined with hose sections and self supporting tube elements.

Figure 8:
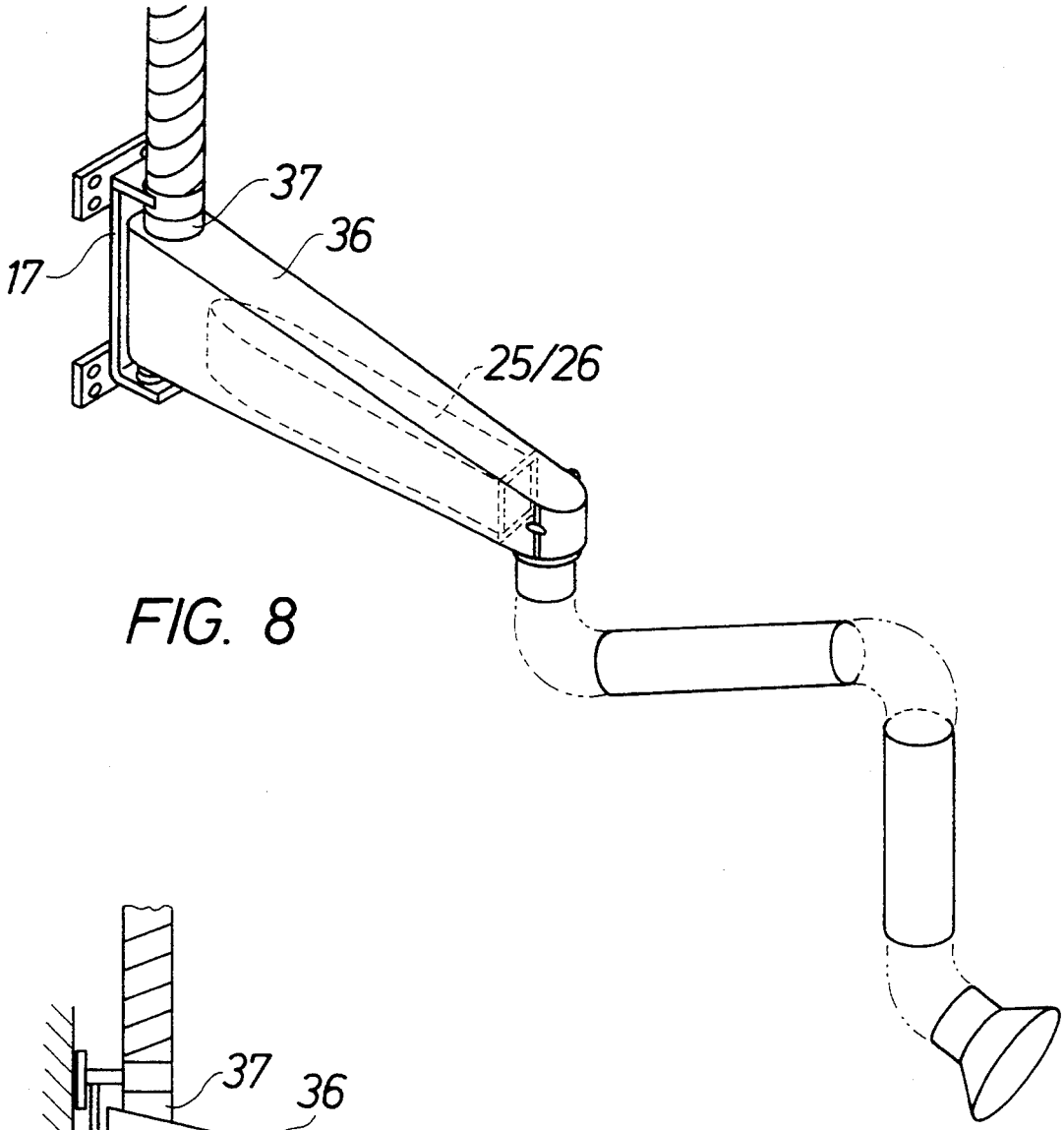
FIG. 8 is a schematic perspective view of an alternative embodiment of the device according to the invention and FIG. 9 is a schematic perspective view of a further alternative embodiment of the device according to the invention.
Figure 9:
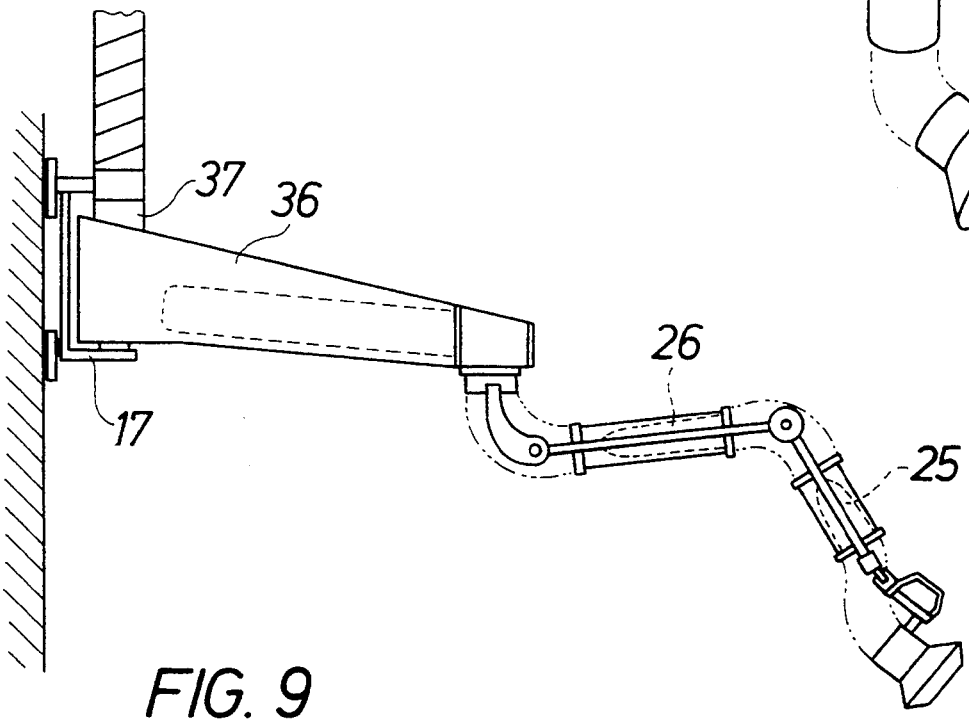

Two further embodiments are schematically shown in FIG. 8 and FIG. 9. The embodiment shown in FIG. 8 and FIG. 9 includes a rigid tube section 36 connected to said wall bracket 17 to be pivoted 180° in a horisontal plane. The embodiment of FIG. 8 further comprises rigid tube sections and intermediate hose sections. The embodiment of FIG. 9 further comprises support arms and hose sections.

Figure 5:
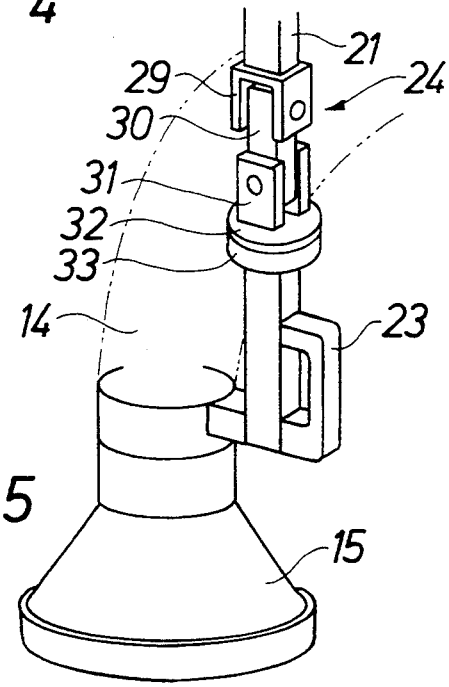
FIG. 5 is a schematic view of a link mechanism included in one embodiment of the device according to the invention.

In embodiments comprising at least one longer hose portion adjacent to said funnel 15, for instance the embodiment shown in FIG. 3 and FIG. 4, a specific embodiment of said link 24 is very suitable. Such an embodiment is shown in FIG. 5. Said link 24 is in a first end thereof connected to a free end of said lower arm 21. A first end of said link is constituted by a first yoke 29 which pivotably supports one end of an intermediate arm 30. A second end of said intermediate arm 30 is in turn pivotably connected to a second yoke 31 which is displaced 90° in relation to said first yoke 29. Thereby said second yoke 31 can be pivoted in two right angles in relation to said first yoke 29. Said second yoke 31 is connected to a plate 32 which forms part of a pivoting link. A second link 33 constitutes a second part of said poviting link. Said handle 23 is in one end connected to said second plate 33 and in a second end connected to said funnel 15. Whereas the hose portion 15 adjacent to said funnel 15 is connected to said lower arm 21 on a comparatively large distance from said link 24 and from a connection point of said handle 23 with said funnel 15, and said link 24 will allow twisting and pivoting of said handle 23 and thereby said funnel 15 in all directions, the flexibility of said hose section 14 is very large. It is thereby possible to adjust said funnel 15 essentially without any obstruction from said hose section 14.

Figure 6:
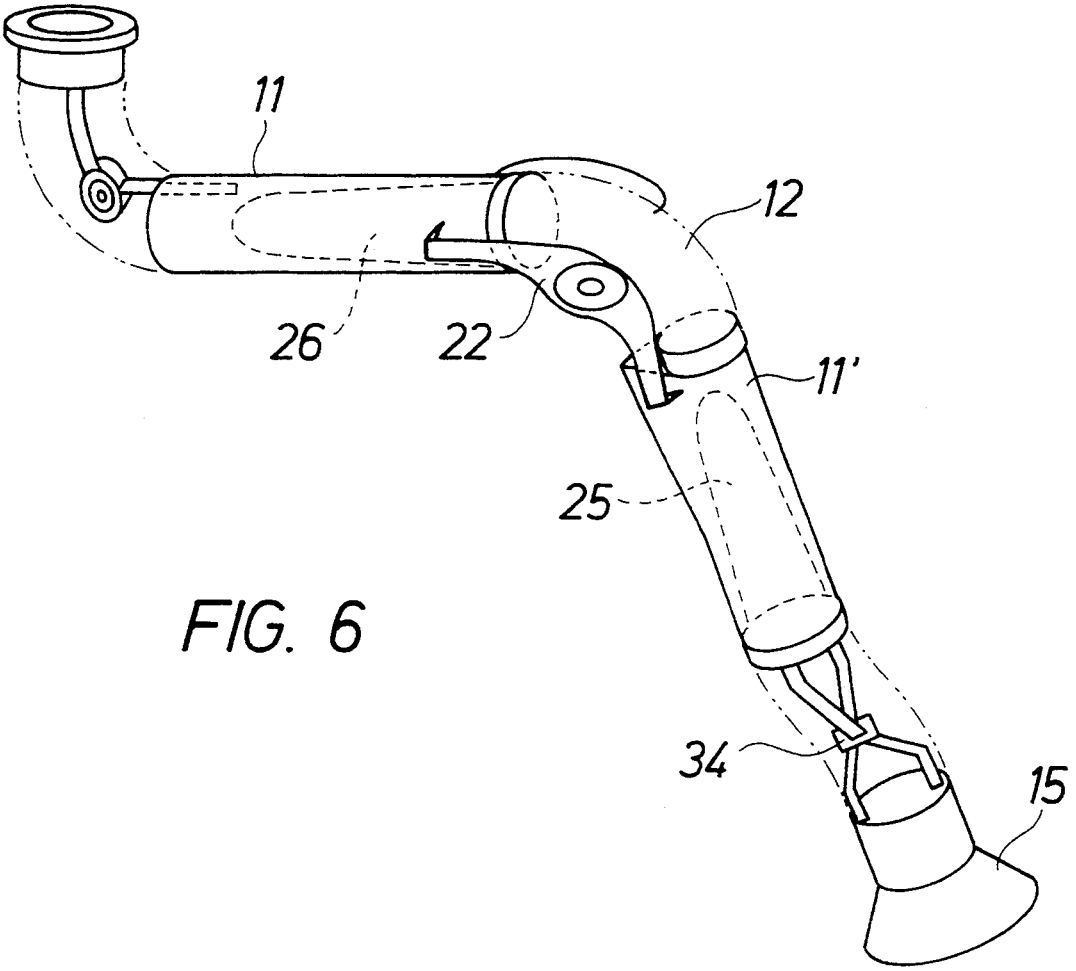
FIG. 6 is a schematic view showing a further alternative embodiment of the device according to the invention.

In an alternative embodiment according to FIG. 6 of the local extraction device according to the invention said first tube section 11 and said second tube section 11' are self-supporting and connected to each other through a link 22. FIG. 6 shows said link 22 to be external but in certain embodiments it is appropriate to arrange said link 22 internally within said hose portion 12. Between said funnel 15 and said second self-supporting tube section 11' there is provided a further hose section which receivs a link 34 connecting said tube section 11' and said funnel. Also embodiments including a link 34 arranged externally of said hose portion are possible, and are preferred in certain applications. It is further possible to include in the local extraction device according to the invention also other combinations of internal and external links.

Figure 7:
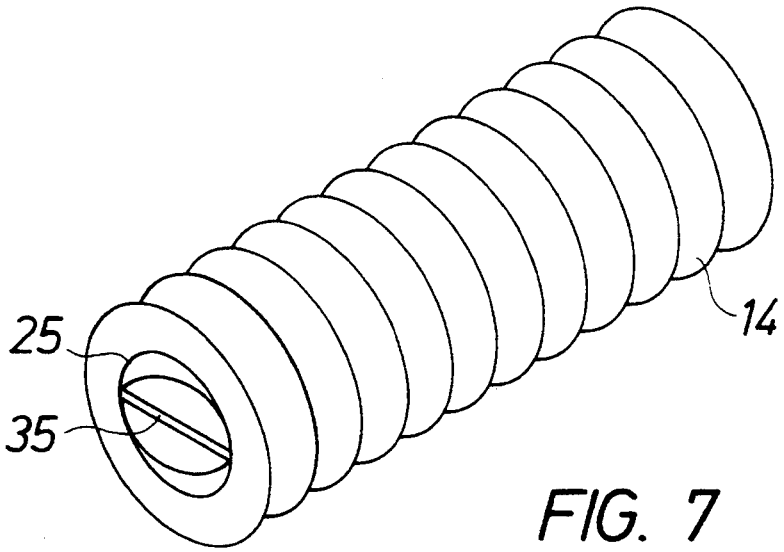
FIG. 7 is a schematic perspective view showing an element of a further developed device according to the invention.

In some embodiments there is an increased risk of particles and dust captured in said filters 25,26 falling off said filter at the working spot. To avoid this problem and other problems said filter 25,26 is provided in an inlet end thereof with a valve that will allow extraction air to enter but will prevent any air going in the reverse direction. Such an embodiment is shown in FIG. 7. Said valve is constituted in the shown embodiment by a self-closing damper 35 that will be opened by any incoming air and that will be automatically closed by a spring biased device when there is no longer any incoming extraction air. In FIG. 7 said damper is shown partly opened. Also other embodiments of the valve are possible within the scope of the present invention.

Within the scope of the present invention supporting arms and links can be formed and arranged in a plurality of other ways than those shown on the accompanying drawings. In some applications double parallelogram links are more appropriate to use and in yet other applications other types of spring biased links are appropriate to use.

The density ratio of said filter 25 is chosen with regard to any desired or filtering level or any filtering level prescribed by law and can easily be changed by exchanging one filter 25 to another filter having other characteristics. In the embodiment shown in FIG. 2 preferably the complete hose 14 including the filter 25 arranged therein is exchanged, and in other embodiments preferably only the filter element is exchanged. When the complete hose 14 is exchanged the hose 14 including the filter is preferably compressed with a cup in both ends. The compressed hose can then easily be disposed of.

Claims:

1. Adjustable local extraction device for extraction of unhealthy smoke, gases and dust from working spots, comprising:

a suction tunnel;

an exhaustion device connected to one end of said suction tunnel;

a nozzle connected to a second end of said suction tunnel; and at least one filter means for filtering air evacuated through said suction tunnel, wherein at least one filter means is supported by said suction tunnel, said suction tunnel being supported by at least one first arm and one second arm that are articulately connected to each other to provide a flexible adjustment of said nozzle to any desired vertical position at said working spot, said extraction device being pivotally mounted to a wall so as to allow the nozzle to be pivoted in a horizontal plane at the working spot.

2. Local extraction device according to claim 1, wherein said suction tunnel is formed as a flexible hose.

3. Local extraction device according to claim 2, wherein said flexible hose is compressible as a bellows.

4. Local extraction device according to claim 1, wherein said suction tunnel is formed as a flexible hose and includes at least one rigid tube portion.

5. Local extraction device according to claim 1, wherein said arms are arranged on the outside of said suction tunnel.

6. Local extraction device according to claim 1, wherein said first and said second arms are arranged within said suction tunnel.

7. Local extraction device according to claim 1, wherein said suction tunnel comprises at least one self-supporting tube portion.

8. Local extraction device according to claim 7, wherein said self-supporting tube is arranged to be pivoted in a horizontal plane, and a first end of said self-supporting tube is connected to a wall bracket.

9. Local extraction device according to claim 8, wherein said filter means is disposed within said tube section.

10. Local extraction device according to claim 8, wherein said suction tunnel comprises a first tube section in a first end thereof adjacent to said exhaustion device, said suction tunnel comprises a second tube portion in a second end thereof adjacent to said nozzle, a first filter means is provided within said second tube portion and a second filter means is provided within said first tube portion, said first filter means having a permeability at least as large as the permeability as said second filter means.

11. Local extraction device according to claim 10, wherein said filter means in an inlet end thereof is provided with a one-way valve means to allow contaminated extraction air to pass through in a first direction, and to prevent any particles captured in said filter means from departing from said filter means in a second direction opposite to said first direction, said valve means being operable by an airflow generated by said exhaustion device.

12. Local extraction device according to claim 11, wherein said first arm at one end thereof is pivotably connected to a tube that is connected to a wall bracket and that is connected to said exhaustion device, and wherein said first arm in a second end thereof is pivotably connected to said second arm that can be moved in a vertical plane that is parallel to a plane of movement of said first arm.

13. Local extraction device according to claim 11, wherein said first arm has a first end, said first arm at said first end being pivotably connected to a third arm that is connected to said wall bracket to be moved in a horizontal plane so that said first arm is pivotably moved in a vertical plane, and a second end of said first arm being pivotably connected to said second arm that can be moved in a vertical plane that is parallel to said vertical plane of movement of said first arm.

14. Local extraction device according to claim 1, further comprising means for linking the nozzle and the second arm, the linking means having a first end connected to a free end of said second arm and a second end connected to the nozzle, the linking means including at least two displaced pivoting elements so as to twist and pivot the nozzle in all directions.

15. Local extraction device according to claim 14, wherein the two displaced pivoting elements are supported by an intermediate arm.

16. Adjustable local extraction device for extraction of unhealthy smoke, gases and dust from working spots, comprising:

a self-supporting suction tube having a first section and a second section;

an exhaustion device being connected to the first section at a first end of the suction tube;

a nozzle being connected to the second section at a second end of the suction tube;

at least one filter means for filtering air evacuated through said suction tube, said at least one filter means being supported by the second section;

the self-supporting suction tube at said first end being connected in a wall bracket and at said second end being pivotally connected to a link member;

means for pivotally connecting the first and second sections; and the second section being pivoted in a vertical plane which is parallel to a vertical plane of movement of the first section to provide a flexible adjustment of the nozzle to any desired vertical position at a working spot and to allow the nozzle to be pivoted in a horizontal plane at the working spot.

* * * * *